US009573019B2

(12) United States Patent
Donohue et al.

(10) Patent No.: US 9,573,019 B2
(45) Date of Patent: Feb. 21, 2017

(54) MOBILITY AID AND REHABILITATION DEVICE AND RELATED COMPONENTS

(71) Applicant: Megeriann Corp., Chapel Hill, NC (US)

(72) Inventors: Miriam B. Donohue, Chapel Hill, NC (US); John Tyler Willis Hagler, Durham, NC (US); Patrick B Murphy, Durham, NC (US); Michael Poorman, Durham, NC (US); Jessica Springer, Durham, NC (US); Drew Brisley, Durham, NC (US); Galen Robertson, Durham, NC (US)

(73) Assignee: Megeriann Corp., Chapel Hill, NC (US)

( * ) Notice: Subject to any disclaimer, the term of this patent is extended or adjusted under 35 U.S.C. 154(b) by 210 days.

(21) Appl. No.: 14/341,729

(22) Filed: Jul. 25, 2014

(65) Prior Publication Data

US 2015/0051520 A1 Feb. 19, 2015

Related U.S. Application Data

(60) Provisional application No. 61/865,215, filed on Aug. 13, 2013.

(51) Int. Cl.
*A61H 1/02* (2006.01)
*A63B 23/04* (2006.01)
(Continued)

(52) U.S. Cl.
CPC ..... *A63B 23/0488* (2013.01); *A61H 1/005* (2013.01); *A61H 1/024* (2013.01); *A61H 1/0259* (2013.01);
(Continued)

(58) Field of Classification Search
CPC ..... A61H 1/00; A61H 1/005; A61H 1/02; A61H 1/0237; A61H 1/024; A61H 1/0244; A61H 1/0259; A61H 1/0266; A61H 1/0292; A61H 2001/0203; A61H 2001/0248; A61H 2001/0251; A61H 2201/0149; A61H 2201/12; A61H 2201/1207; A61H 2201/1215; A61H 2201/149; A61H 2201/123; A61H 2201/1238; A61H 2201/1633; A61H 2201/164; A61H 2201/1664; A61H 2201/1676; A61H 9/00; A61H 9/005; A63B 21/4047; A63B 21/0058; A63B 21/4045; A63B 23/0488; A63B 23/0417; A63B 23/08
See application file for complete search history.

(56) References Cited

U.S. PATENT DOCUMENTS 3,060,926 A * 10/1962 May ..... A61G 13/009 601/35
4,207,879 A * 6/1980 Safadago ..... A61G 13/009 482/142
(Continued)

*Primary Examiner* — Quang D Thanh
(74) *Attorney, Agent, or Firm* — NK Patent Law, PLLC

(57) ABSTRACT

A mobility and exercise system includes a user support platform, a leg platform connected to the user support platform, a first linearly movable mount and a second linearly movably mount each coupled to the leg platform and movable relative to the leg platform in two directions parallel to a longitudinal axis of the leg platform. A first abducting arm and a second abducting arm are coupled to the leg platform, each by a respective hinge. The first and second abducting arms are movable relative to the leg platform by swinging motion away from the longitudinal axis and back toward the longitudinal axis. A first foot cradle is mounted on the first linearly movable mount or the first abducting arm, and second foot cradle is mounted on the
(Continued)

second linearly movable mount or the second abducting arm.

12 Claims, 5 Drawing Sheets

(51) Int. Cl.
*A61H 1/00* (2006.01)
*A61H 9/00* (2006.01)
*A63B 21/005* (2006.01)
*A63B 23/08* (2006.01)

(52) U.S. Cl.
CPC ..... *A61H 1/0266* (2013.01); *A61H 1/0292* (2013.01); *A61H 9/0078* (2013.01); *A61H 2201/0149* (2013.01); *A61H 2201/1215* (2013.01); *A61H 2201/1238* (2013.01); *A61H 2201/149* (2013.01); *A61H 2201/164* (2013.01); *A61H 2201/1664* (2013.01); *A61H 2201/1676* (2013.01); *A63B 21/0058* (2013.01); *A63B 21/4045* (2015.10); *A63B 21/4047* (2015.10); *A63B 23/0417* (2013.01); *A63B 23/08* (2013.01)

(56) References Cited

U.S. PATENT DOCUMENTS

| | | | | |
|---|---|---|---|---|
| 4,751,917 | A * | 6/1988 | Ruf | A61H 1/0259 482/8 |
| 4,869,497 | A | 9/1989 | Stewart et al. | |
| 5,122,106 | A * | 6/1992 | Atwood | A61H 1/0244 482/131 |
| 5,658,222 | A | 8/1997 | Brown | |
| 5,853,353 | A | 12/1998 | Blumel | |
| 7,572,213 | B2 | 8/2009 | Bucay-Bissu et al. | |
| 7,682,296 | B2 | 3/2010 | Brown | |
| 2008/0242521 | A1 | 10/2008 | Einav | |
| 2009/0118106 | A1 | 5/2009 | Leisenring et al. | |
| 2010/0016766 | A1 | 1/2010 | Zhang et al. | |
| 2010/0249672 | A1 | 9/2010 | Ewing | |
| 2010/0323860 | A1 * | 12/2010 | Reed | A63B 21/0058 482/135 |
| 2011/0275500 | A1 * | 11/2011 | Hur | A63B 21/00065 482/142 |
| 2012/0109025 | A1 | 5/2012 | Weinberg et al. | |
| 2012/0232449 | A1 | 9/2012 | Arnstein | |
| 2012/0289870 | A1 | 11/2012 | Hsiao-Wecksler et al. | |
| 2013/0030327 | A1 | 1/2013 | Zhang et al. | |

* cited by examiner

MOBILITY AID AND REHABILITATION DEVICE AND RELATED COMPONENTS

CROSS-REFERENCE TO RELATED APPLICATION

This application claims the benefit of priority of U.S. provisional patent application No. 61/865,215, titled "Mobility Aid and Rehabilitation Device and Related Components," filed on Aug. 13, 2013, which is incorporated herein in its entirety by this reference.

TECHNICAL FIELD

This disclosure is related to a mobility aid and rehabilitation system and related components. More specifically, this disclosure is related to a device that can provide convenient and customized physical therapy to a patient in a treatment setting.

BACKGROUND

A growing concern within the healthcare industry is the lack of patient mobility, especially those confined to a bed for a significant portion of the day. The stationary condition of a patient can lead to decreased joint function and an increased likelihood of blood clot formation. Such secondary issues can ultimately lead to longer hospital stays and increased healthcare related costs. There is a strong need for a device that will enable patients to get appropriate physical therapy and movement exercises.

Providing patients with a manner to exercise will reduce incidences of these secondary issues that arise from being bed ridden and/or sedentary. However, presently available devices are ineffective in addressing these issues. Such devices are either difficult to use, or lack coordinated control of movements and/or resistance to movements.

A need therefore exists for a solution that addresses these disadvantages.

SUMMARY

This Summary is provided to introduce in a simplified form concepts that are further described in the following detailed descriptions. This Summary is not intended to identify key features or essential features of the claimed subject matter, nor is it to be construed as limiting the scope of the claimed subject matter.

In at least one embodiment, a mobility and exercise system includes: a user support platform, a leg platform connected to the user support platform; a first linearly movable mount and a second linearly movably mount, each coupled to the leg platform and movable relative to the leg platform in two directions parallel to a longitudinal axis of the leg platform; a first abducting arm and a second abducting arm, each coupled to the leg platform by a respective hinge, the first and second abducting arm movable relative to the leg platform by swinging motion away from the longitudinal axis and back toward the longitudinal axis; a first foot cradle mounted on the first linearly movable mount or the first abducting arm; and a second foot cradle mounted on the second linearly movable mount or the second abducting arm.

In at least one example, the leg platform is connected to the user support platform by a hinge and is movable by rotation around the hinge between a raised position and a lowered position.

In at least one example, the first linearly movable mount is coupled to a first linear actuator having a power-assist mode in which the first linear actuator applies force to move the first linearly movable mount.

In at least one example, the first linearly movable mount is coupled to a first linear actuator having a resist mode in which the first linear actuator applies force to resist motion of the first linearly movable mount.

In at least one example, the first linearly movable mount is coupled to a first linear actuator through a slot defined through a surface of the leg platform.

In at least one example, the leg platform defines two lateral sides in each of which a respective channel is formed to receive a respective one of the first abducting arm and second abducting arm in a stowed configuration of the first abducting arm and second abducting arm.

In at least one example, the user support platform defines a generally horizontal patient seat and comprises at least one actuating patient support panel that hinges about a horizontal axis from a lowered position essentially flush with or flat upon the patient seat to a rotated position in which at least a portion of the actuating patient support panel is raised.

In at least one example, the user support platform defines a generally horizontal user seat and comprises a pair of actuating user support panels, each user support panel of which hinges about a central longitudinally extending horizontal axis of the user seat from a lowered position essentially flush with or flat upon the user seat to a rotated position in which an outer lateral edge of the panel is raised.

In at least one example, each of two bladders is independently inflatable and deflatable, and each bladder is positioned below a respective one of the user support panels and raises and lowers the respective one of the user support panels upon inflation and deflation respectively.

In at least one example, air supply lines are configured to provide air to the bladders in alternating order to raise and lower the actuating user support panels in alternating fashion to facilitate shifting a user torso to lean right and left in alternating movements.

In at least one example, a foot cradle includes a mounting bracket by which the foot cradle is mounted on a linearly movable mount or abducting arm, a hinge assembly connected to the mounting bracket, and a foot platform connected to the hinge assembly and rotatable relative to the mounting bracket.

In at least one example, the hinge assembly permits rotation of the foot platform corresponding to ankle flexure and extension of a user.

In at least one example, the hinge assembly applies powered assistance to rotation of the foot platform relative to the mounting bracket.

In at least one example, the hinge assembly applies resistance to rotation of the foot platform relative to the mounting bracket.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTION

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Figure 1:
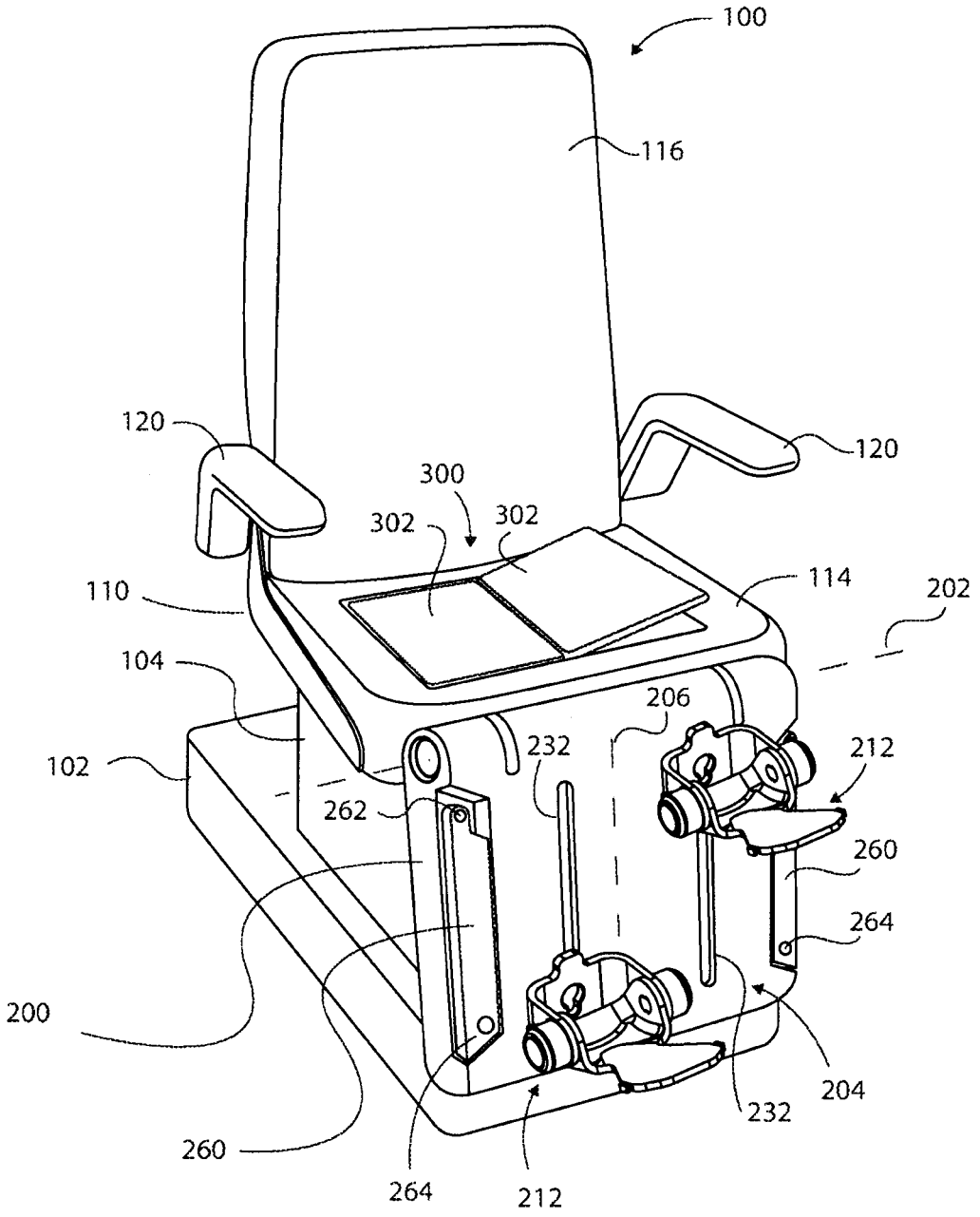
FIG. 1 is a perspective view of a mobility rehabilitation system, according to at least one embodiment, shown as a chair with a lower leg platform in a vertical position.

FIG. 1 is a perspective view of a mobility rehabilitation system 100, according to at least one embodiment, shown with a lower leg platform 200 in a vertical position. The mobility and rehabilitation system 100 is illustrated as a patient support platform in chair form. The mobility rehabilitation system 100 has a lower base 102 and a pedestal 104 supported by and extending upward from the base 102. A patient support chair 110 is mounted on the top of the pedestal 104. The patient support chair 110 is illustrated as having a generally horizontal patient seat 114 from the back edge of which a fixed upright back support 116 extends approximately vertically. In some embodiments, the back support can be lowered to reclined positions. Left and right arm rests 120 extend forward from lateral sides of the back support 116 to support the arms of a seated patient or other user.

The mobility rehabilitation system 100 includes a lower leg platform 200 shown in FIG. 1 in a lowered approximately vertical position. The lower leg platform supports and engages the lower legs, portions of the legs below the knee, of a seated patient. A proximal end of the lower leg platform 200 is connected to the front edge of the of the patient seat 114 by a hinge and hinges about a horizontal axis 202 between the lowered vertical position of FIG. 1 and the raised horizontal position of FIG. 2. The patient support chair 110, including the patient seat 114, arm rests 120, and lower leg platform 200, may be textured and padded to provide grip and comfort the patient. They may be formed and/or covered with material that sustains cleaning, for example by disinfectants and other liquid cleaners.

Figure 2:
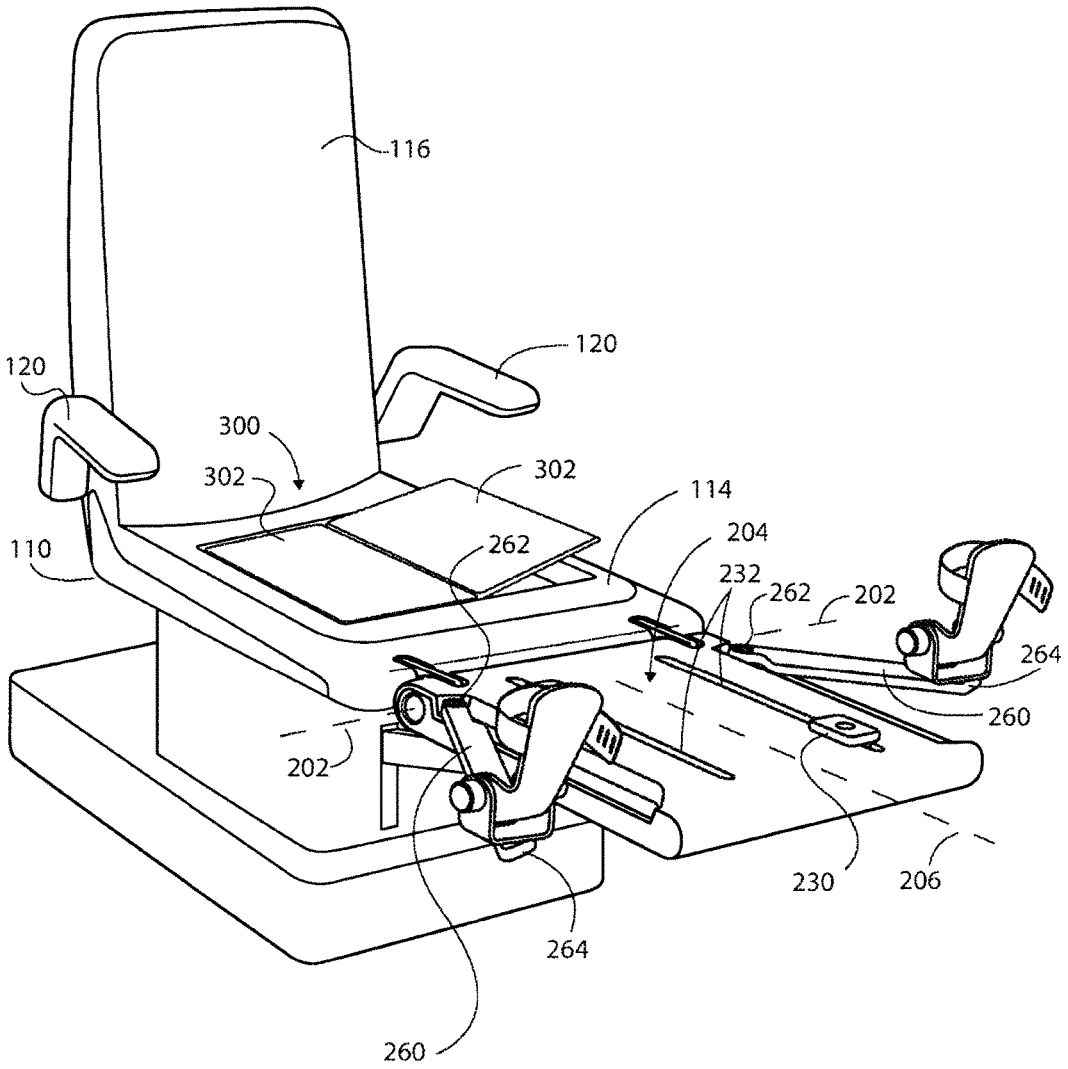
FIG. 2 is a perspective view of the mobility rehabilitation system of FIG. 1, shown with the lower leg platform raised to a horizontal position.

In any position, whether the lowered vertical position of FIG. 1, the raised horizontal position of FIG. 2, or somewhere between, the lower leg platform 200 defines along its anterior side 204 a longitudinal axis 206 that corresponds to the approximate dispositions of the lower legs of a patient. Thus, like the lowers legs extending perpendicularly to the hinging axis of the knee, the longitudinal axis 206 of the lower leg platform 200 is perpendicular to the horizontal axis 202 about which the platform 200 hinges. With the lower leg platform 200 in the lowered vertical position of FIG. 1, the longitudinal axis 206 of the lower leg platform 200 is approximately vertical. With the lower leg platform 200 in the raised horizontal position of FIG. 2, the longitudinal axis 206 of the lower leg platform 200 is approximately horizontal.

In FIG. 1, the mobility rehabilitation system 100 is configured for leg motions in which the knees are flexed and extended by motion of patient feet in alternating directions parallel to the longitudinal axis 206. In FIG. 2, the mobility rehabilitation system 100 is configured at least for leg abduction motions. These two configurations are further described after the following descriptions of the foot cradles 212, which are used in each such configuration.

Figure 3:
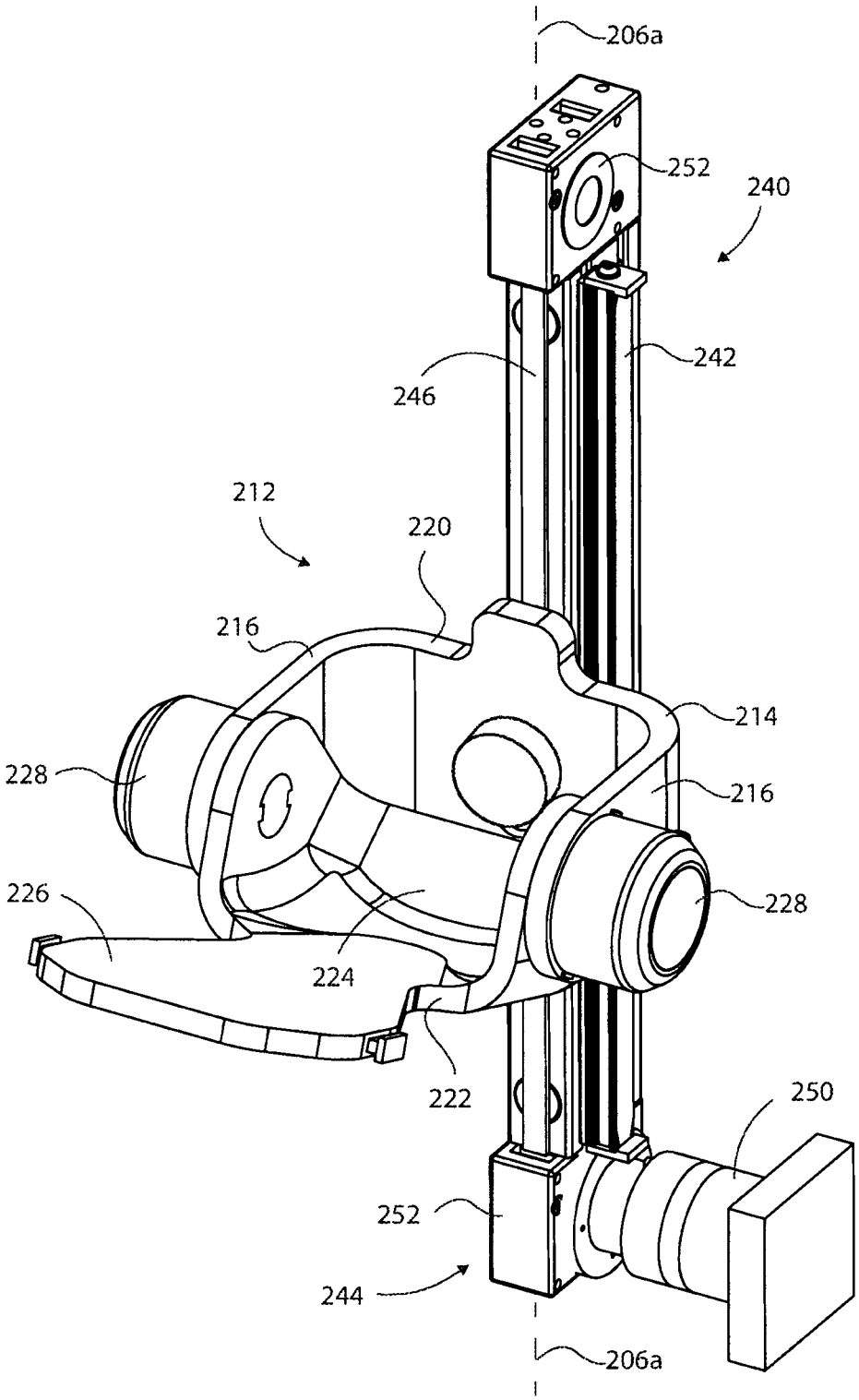
FIG. 3 is a perspective view of a lower leg mobility assembly with a dynamic foot cradle according to at least one embodiment.

The mobility rehabilitation system 100 includes a left foot cradle 212 and a right foot cradle 212 that dynamically extend from the lower leg platform 200 in at least two configurations corresponding to FIGS. 1 and 2. The foot cradle 212 illustrated in FIGS. 3-4 represents both the left and right foot cradles 212 shown in FIGS. 1-2. Each foot cradle 212 includes a U-shaped bracket 214 having two arms 216 and a base 220 from with the arms 216 extend. A foot platform 222 is attached to the distal ends of the arms 216, spanning the U-shaped bracket 214 to engage the foot of a seated patient.

Each foot platform 222 has a rear heel cup 224, for supporting and engaging the heel of the patient, and a forward plate 226 for supporting and engaging portions of the foot beyond the heel. Each lateral side of the foot platform 222 is connected to the U-shaped bracket 214 by a respective hinge assembly 228. The hinge assemblies 228 permit rotation of the foot platform 222 around a horizontal axis defined through the center of the hinge assemblies through an angular range of motion corresponding to normal flexure and extension of the human foot about the ankle. The hinge assemblies 228 apply controllable variable resistance and/or powered assistance to the rotation of the foot platform 222.

Each foot cradle 212 can be attached as shown in FIG. 1 to one of two mounting plates 230, one of which can be seen in FIG. 2. Each mounting plate 230 defines a mount to which a foot cradle 212 can be attached as shown in FIG. 1 for use in leg flexion and extension therapy or exercises. The two mounting plates travel respectively along two longitudinally extending slots 232 defined in the anterior side 204 of the lower leg platform 200. Alternatively, each foot cradle 212 can be attached, as shown in FIG. 2, to one of two abducting arms 260 that swing away from lateral sides of the lower leg platform 200.

With the foot cradles 212 attached as shown in FIG. 1 to the respective mounting plates 230 (see FIG. 2) that travel along the longitudinally extending slots 232, the foot cradles 212 can execute motion in two opposing directions parallel to the longitudinal axis 206. Motion toward the patient seat 114 and proximal end of the lower leg platform 200 corresponds to motion in which the knee of a patient is flexed toward a bent-leg position. Opposite motion away from the patient seat 114 and toward the distal end of the lower leg platform 200 corresponds to motion in which the knee of a patient is extended toward a straight-leg position. In FIG. 1, the patient-left foot cradle 212 is shown in a longitudinally near position for leg flexure, and the patient-right foot cradle 212 is shown in a longitudinally far position for leg extension.

FIG. 3 is a perspective view of a foot cradle 212 mounted on a lower leg mobility assembly 240 according to at least one embodiment. The lower leg mobility assembly 240 includes a track 242 upon which the foot cradle 212 moves bi-directionally along a longitudinally extending axis 206*a*, corresponding to two directions of linear motion parallel to the longitudinal axis 206 of FIGS. 1-2. The mounting plate 230 (see FIG. 2), engages the base 220 of the U-shaped bracket 214, and travels along the track 242 with the foot cradle 212.

The mobility assembly 240 (FIG. 3) includes a linear actuator. In the illustrated embodiment, the linear actuator 244 is defined by a belt 246 that travels longitudinally along the track 242 by motion of a rotary motor 250 and opposing pulleys 252 or other guided turning points at the longitudinal ends of the track 242. The linear actuator 244 forces the foot cradle 212 along the longitudinally extending axis 206*a* in the power-assist mode to apply leg movement therapy to a patient. The linear actuator 244 may apply variable resistance to motion along the longitudinally extending axis 206*a* in the resist mode as a patient conducts push-pull leg movement exercises. The linear actuator 244 is housed by the body of the lower leg platform 200 with the mounting plate 230 (see FIG. 2) positioned forward of the anterior side 204 to engage the foot cradle 212.

Whether in the power-assist mode or the resist mode of the linear actuators 244, the foot cradles 212 mounted on the mounting plates 230 can execute bi-directional movement along the longitudinally extending slots 232 for patient leg flexures and extensions. Such movements can be executed with the lower leg platform 200 in the lowered vertical position of FIG. 1, the raised horizontal position of FIG. 2, or somewhere between, according to a prescribed therapy, exercise or conditioning regimen or program or according to the desires of a patient or caregiver.

In FIG. 2, the left and right foot cradles 212 are attached to the respective left and right abducting arms 260. As shown in FIG. 1, the left and right abducting arms 260 are received in respective channels formed at the lateral edges of the anterior side 204 of the lower leg platform 200. Thus, the positions in FIG. 1 represent a stowed configuration of the abducting arms 260 and their most inward positions when engaged in leg abduction therapy or exercises, which refers to spreading movement of the legs approximately in the frontal or coronal plane of the patient body. In use, the abducting arms 260 abduct by swinging away from the longitudinal axis 206 and return by swinging back toward the longitudinal axis 206. Each abducting arm 260 is attached at its proximal end by a pivot point or hinge 262 to the lower leg platform 200. The distal end of each abducting arm defines a mount 264 to which a foot cradle 212 can be attached as shown in FIG. 2 for use in leg abduction therapy or exercises.

The positions in FIG. 2 represent a deployed configuration of the abducting arms 260 and outward swung positions for leg abduction therapy or exercises. Movement of the abducting arms 260 may be freely executed by movement of patient legs. In some embodiments, the powered assistance and/or variable resistance may be applied to or against movement of the abducting arms 260 by the mobility rehabilitation system 100, according to a prescribed therapy or exercise regimen or the desires of a patient or caregiver.

Figure 4A:
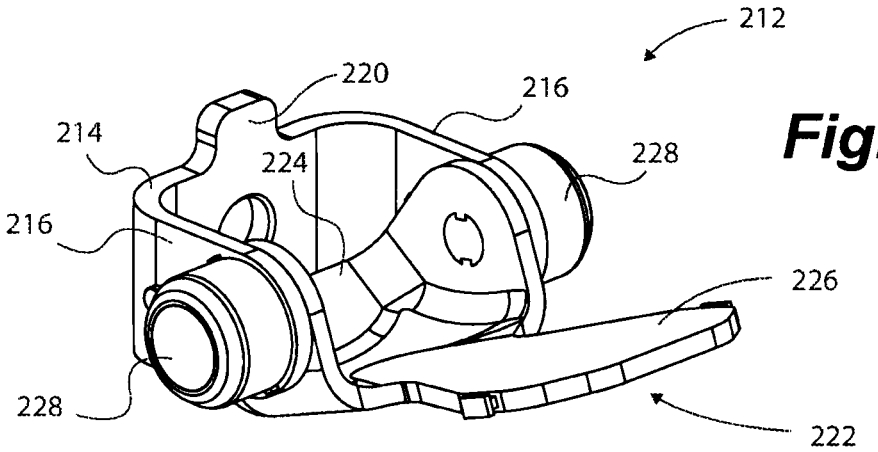
FIG. 4A is a perspective view of the dynamic foot cradle of FIG. 3, having a foot support plate at a raised angle for calf stretching.
Figure 4B:
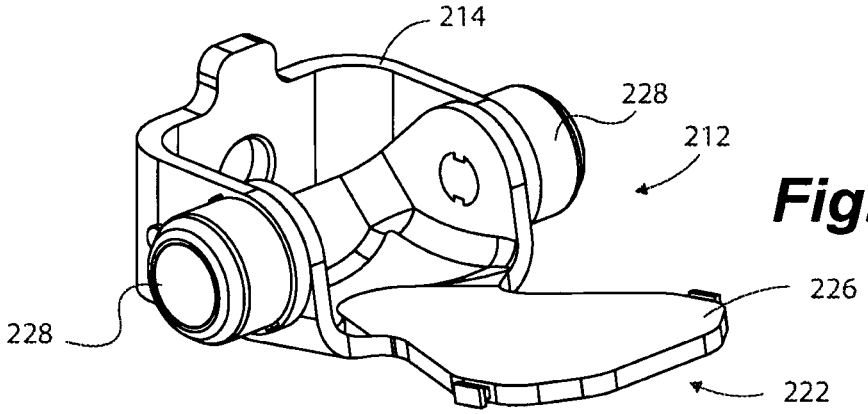
FIG. 4B is a perspective view of the dynamic foot cradle of FIG. 4A, having the foot support plate in a neutral angle.
Figure 4C:
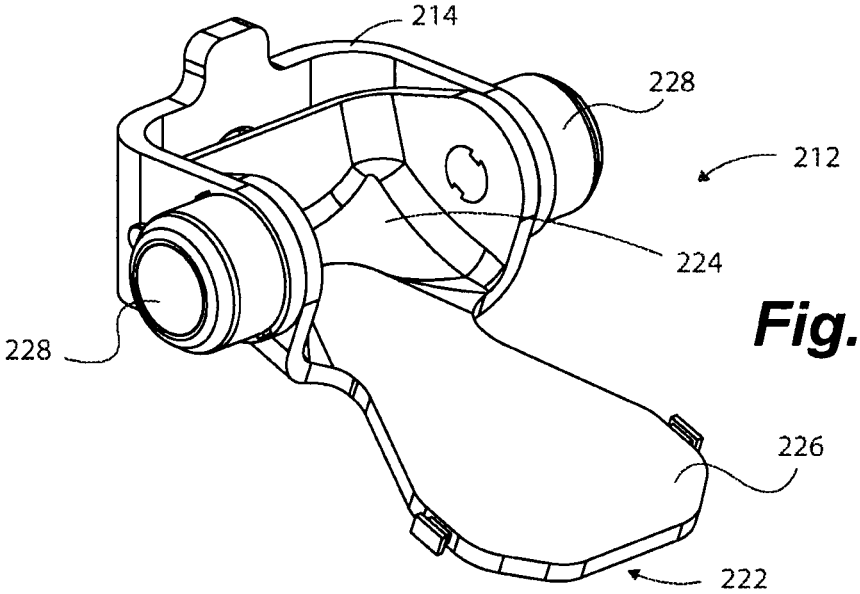
FIG. 4C is a perspective view of the dynamic foot cradle of FIG. 4A, having the foot support plate at a lowered angle for calf contraction.

FIG. 4A is a perspective view of the dynamic foot cradle 212 of FIG. 3, having a foot platform at a raised angle for calf stretching. FIG. 4B is a perspective view of the dynamic foot cradle of FIG. 4A, having the foot platform in a neutral angle. FIG. 4C is a perspective view of the dynamic foot cradle of FIG. 4A, having the foot platform 222 at a lowered angle for calf contraction. FIGS. 4A-4C together illustrated the approximate range of motion of the foot platform 222 in its range of rotation around the horizontal axis defined through the center of the hinge assemblies 228, which may apply controllable variable resistance and/or powered assistance to the rotation of the foot platform 222, according to a prescribed therapy or exercise regimen or the desires of a patient or caregiver. Variable resistance may be applied by the hinge assemblies as a patient conducts ankle flexion exercises, and powered may be applied as ankle flexion therapy is applied to the patient.

The movement and positions of the foot platforms 222 may be coordinated with the movement of the foot cradles 212 cradles overall, for example to coordinate calf contractions and extensions with movement of the foot cradles 212 along the longitudinally extending slots 232 for knee flexures and extensions (FIG. 1).

Figure 5:
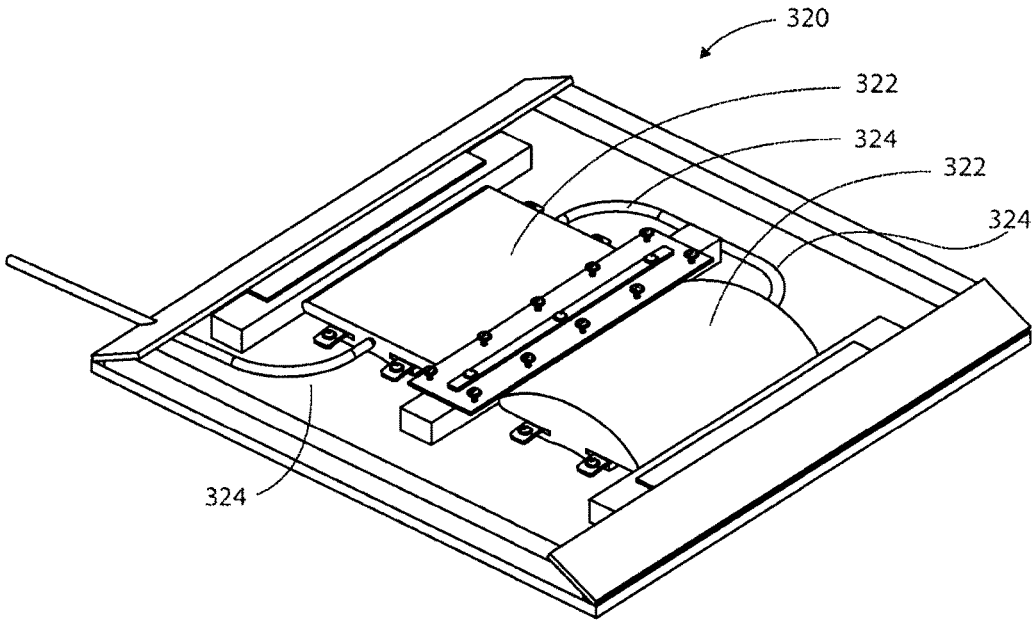
FIG. 5 is a perspective view of a fluid-driven dual-actuator core-balance motion system according to at least one embodiment.

The mobility rehabilitation system 100 furthermore facilitates core balance therapy or exercises. As shown in FIGS. 1 and 2, the mobility rehabilitation system 100 includes a core movement system 300 that includes a pair of actuating patient support panels 302. Each actuating panel 302 hinges about a central longitudinally extending horizontal axis of the patient seat 114 from a lowered position essentially flush with or flat upon the patient seat 114, to a rotated position in which the outer lateral edge of the panel is raised. The patient-left actuating panel 302 is illustrated in a raised position in FIGS. 1-2, where the patient-right actuating panel 302 is illustrated in a lowered position. The actuating patient support panels 302 execute powered raising and lowering motions responsively to forces applied by an actuating system, an exemplary embodiment of which is illustrated in FIG. 5. The raising and lowering motions of the patient support panels may be coordinated according to any prescribed therapy or exercise regimen or the desires of a patient or caregiver.

For example, in FIGS. 1-2, the patient-left actuating panel 302 is illustrated in a raised position and the patient-right actuating panel 302 is illustrated in a lowered position corresponding to a therapy or conditioning program in which the left and right panels 302 are raised in alternating fashion, shifting the patient torso core to lean right and left in alternating movements. This prompts natural balance response shifting and movement, including side-to-side torso bending, by the patient, applying gentle exercise and balance therapy and conditioning to train and strengthen stabilizer muscles.

FIG. 5 is a perspective view of a dual actuator system 320, according to at least one embodiment, that applies forces to raise and lower the patient support panels 302 of FIGS. 1-2. The dual actuator system 320 includes two actuators 322 that are arranged opposite each other on respective lateral sides of a central longitudinal axis corresponding to that of the patient seat 114. One of the two actuators 322 is illustrated in FIG. 5 as raised, corresponding to the patient-left actuating panel 302 illustrated as raised in FIGS. 1-2. The other of the two actuators is illustrated as lowered, corresponding to the patient-right actuating panel 302 illustrated as lowered in FIGS. 1-2. The raising and lowering motions of the actuators 322 patient may be coordinated according to any prescribed therapy or exercise regimen or the desires of a patient or caregiver. For example, the actuators may be raised and lowered in alternating fashion to facilitate shifting the patient torso core to lean right and left in alternating movements as described with reference to the actuating patient support panels 302.

In the illustrated embodiment, the actuators 322 are fluid-driven bladders that inflate, expanding upward, under fluid pressure provided by fluid supply lines 324, and deflate downward when fluid pressure is relieved through the fluid supply lines 324 or other outlets. For example, the fluid supply lines 324 in at least one example supply pressured air to raise and lower the actuators 322 by air pressure independently. The raising and lowering motions of the actuators 322 prompt corresponding raising and lowering motions of the patient support panels 302, and may be coordinated according to any prescribed therapy or exercise regimen or the desires of a patient or caregiver. For example, fluid supply lines 324 may provide air or other fluid pressure to the bladders in alternating order to raise and lower the actuating patient support panels 302 in alternating fashion to facilitate shifting the patient torso core to lean right and left in alternating movements.

The mobility rehabilitation system 100 may include a controller and sensors for monitoring the powered and variable resist function described above. In at least one embodiment a computing module monitors positions and other characteristics of the lower leg platform 200, the foot cradles 212, the mounting plates 230, and actuating panels 302. The computing module may be in wired or wireless communication with other on-board or ancillary devices to monitor one or more characteristics thereof and of the patient. For example, the computing module may monitor the forces applied to the foot cradles 212, the speed or revolutions applied to the foot cradles, and other characteristic of the patient such as heart rate, temperature, blood pressure and other condition indicators. These characteristics are provided as non-limiting examples only and many more characteristics may be monitored if desired.

The computer module may be in communication with a display screen, which may be a television type screen or other monitor, such as, for example, a tablet or other personal display device. The computer module may be further configured to instruct the display screen to display a video for use as entertainment or in a virtual reality setting.

Interactive displays may be provided on the display screen or a personal display device. For example, goal-based competitive games may be used in therapy to stimulate and motivate the patient. A score and points reward system may acknowledge progress.

These and other embedded electronics devices may allow a physical therapist to customize a patient's exercise regimen and select software-managed resistance levels while also capturing overall progress for improved objectivity in demonstrating patient progress. The system 100 may also integrate audio and visual elements that engage the patient and create an intrinsically motivated incentive to complete exercises as well as reduce perception of pain and discomfort.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed:

1. A mobility and exercise system comprising:

a user support platform;

a leg platform connected to the user support platform;

a first linearly movable mount and a second linearly movably mount, each coupled to the leg platform and movable relative to the leg platform in two directions parallel to a longitudinal axis of the leg platform;

a first abducting arm and a second abducting arm, each coupled to the leg platform by a respective hinge and each movable relative to the leg platform by swinging motion away from the longitudinal axis and back toward the longitudinal axis;

a first foot cradle mounted on the first linearly movable mount or the first abducting arm; and a second foot cradle mounted on the second linearly movable mount or the second abducting arm.

2. A mobility and exercise system according to claim 1, wherein the leg platform is connected to the user support platform by a hinge and is movable by rotation around the hinge between a raised position and a lowered position.

3. A mobility and exercise system according to claim 1, wherein the first linearly movable mount is coupled to a first linear actuator having a power-assist mode in which the first linear actuator applies force to move the first linearly movable mount.

4. A mobility and exercise system according to claim 1, wherein the first linearly movable mount is coupled to a first linear actuator having a resist mode in which the first linear actuator applies force to resist motion of the first linearly movable mount.

5. A mobility and exercise system according to claim 1, wherein the first linearly movable mount is coupled to a first linear actuator through a slot defined through a surface of the leg platform.

6. A mobility and exercise system according to claim 1, wherein the leg platform defines two lateral sides in each of which a respective channel is formed to receive a respective one of the first abducting arm and second abducting arm in a stowed configuration of the first abducting arm and second abducting arm.

7. A mobility and exercise system according to claim 1, wherein the user support platform defines a generally horizontal patient seat and comprises at least one actuating patient support panel that hinges about a horizontal axis from a lowered position essentially flush with or flat upon the patient seat to a rotated position in which at least a portion of the actuating patient support panel is raised.

8. A mobility and exercise system according to claim 1, wherein the user support platform defines a generally horizontal user seat and comprises a pair of actuating user support panels, each actuating user support panel of which hinges about a central longitudinally extending horizontal axis of the user seat from a lowered position essentially flush with or flat upon the user seat to a rotated position in which an outer lateral edge of the actuating user support panel is raised.

9. A mobility and exercise system according to claim 8, further comprising a pair of bladders, each bladder of which is independently inflatable and deflatable, and each bladder of which is positioned below a respective one of the actuating user support panels and raises and lowers the respective one of the actuating user support panels upon inflation and deflation respectively.

10. A mobility and exercise system according to claim 9, further comprising air supply lines configured to provide air to the bladders in alternating order to raise and lower the actuating user support panels in alternating fashion to facilitate shifting a user torso to lean right and left in alternating movements.

11. A mobility and exercise system according to claim 1, wherein the first foot cradle comprises:

a mounting bracket by which the first foot cradle is mounted on the first linearly movable mount or the first abducting arm;

a hinge assembly connected to the mounting bracket; and a foot platform connected to the hinge assembly and rotatable relative to the mounting bracket.

12. A mobility and exercise system according to claim 11, wherein the hinge assembly permits rotation of the foot platform corresponding to ankle flexure and extension of a user.

* * * * *